United States Patent [19]

Dietz

[11] 4,093,057

[45] June 6, 1978

[54] GATE ASSEMBLY FOR A COIN SELECTING AND SEPARATING DEVICE

[75] Inventor: Kristen H. Dietz, Florissant, Mo.

[73] Assignee: Coin Acceptors, Inc., St. Louis, Mo.

[21] Appl. No.: 774,252

[22] Filed: Mar. 4, 1977

[51] Int. Cl.[2] ..... G07F 1/00

[52] U.S. Cl. ..... 194/1 R

[58] Field of Search ..... 194/1 R, 1 E, 97, 99, 194/100, 101, 102, 103

[56] References Cited

U.S. PATENT DOCUMENTS

| | | | |
|---|---|---|---|
| 2,718,352 | 9/1955 | Nicolaus | 194/1 K |
| 3,163,278 | 12/1964 | Rounsivell | 194/102 X |
| 3,382,962 | 5/1968 | Nielsen | 194/97 R |

*Primary Examiner*—Allen N. Knowles

*Attorney, Agent, or Firm*—Cohn, Powell & Hind

[57] ABSTRACT

A gate assembly for a coin selecting and separating device in which a first gate has a pin inserted into a first hinge socket on a main plate and another pin aligned with but operatively disconnected from the first hinge socket in an open position of the gate relative to the main plate. A key on the first gate precludes angular movement of the first gate from the open position. A second gate includes a pin disposed in a second hinge socket on the first gate. The first and second gates are shiftable as a unit to operatively disengage the key and to insert the aligned pin of the first gate into the first hinge socket for hingedly connecting the first gate for angular movement of the gates to a closed position relative to the main plate. A stop member on the second gate precludes angular movement of the second gate from an open position relative to the main plate until the first gate is hingedly connected. An abutment is provided on the main plate that engages the second gate to preclude removal of the second gate pin from its associated second hinge socket when the first gate is hingedly connected. The stop member of the second gate engages the main plate when the second gate is moved from its open position to preclude shifting of the first and second gates as a unit to disconnect the first gate hingedly from the first hinge socket.

10 Claims, 14 Drawing Figures

GATE ASSEMBLY FOR A COIN SELECTING AND SEPARATING DEVICE

BACKGROUND OF THE INVENTION

This invention relates generally to improvements in a gate assembly for a coin selecting and separating device, and more particularly to the hinge connection of a pair of cooperating gates to the main plate.

In heretofore conventional coin selecting and separating devices, the hinge connections of the gates to the main plate utilized a separate pivot pin and a pair of interconnecting torsion springs. The assembling and disassembling of these gate parts was difficult and time consuming, and required the use of tools.

SUMMARY OF THE INVENTION

In the present coin selecting and separating device, the hinge connection of the gates to the main plate can be assembled and disassembled quickly and easily without the use of any tools.

A first gate of the gate assembly includes a pin that is inserted into a first hinge socket means on the main plate means, and another pin aligned with but operatively disconnected from the first hinge socket means in an open position of the gate relative to the main plate means. A key means precludes angular movement of the first gate from the open position. A second gate includes pin means disposed in a second hinge socket means on the first gate. The first and second gates are shiftable as a unit to operatively disengage the key means and to insert the aligned pin of the first gate into the first hinge socket means for hingedly connecting the first gate for angular movement of the gates to a closed position relative to the main plate means.

A stop means in the gate assembly precludes angular movement of the second gate from an open position relative to the main plate except when the first gate is operatively hingedly connected.

In the present gate assembly, the key means is inserted into and engages the first hinge socket means to preclude angular movement of the first gate from the open position, and is withdrawn and disengaged from the first hinge socket means when the first and second gates are shifted as a unit to insert the aligned pin of the first gate into the first hinge socket means for hingedly connecting the first gate.

An abutment fixed relative to the main plate means engages the second gate to preclude removal of the second gate pin means from its associated second hinge socket means when the first gate is hingedly connected.

The stop means of the second gate engages the main plate means when the second gate is moved from its open position to preclude shifting of the first and second gates as a unit to effect hinged disconnection of the first gate from the first hinge socket means.

Provided on the main plate means is a bearing means that rotatively seats the pin means of the second gate, the bearing means including an abutment that engages the pin means to preclude removal of the pin means from its associated hinge sockets when the first gate is hingedly connected.

DESCRIPTION OF THE PREFERRED EMBODIMENT

Figure 12:
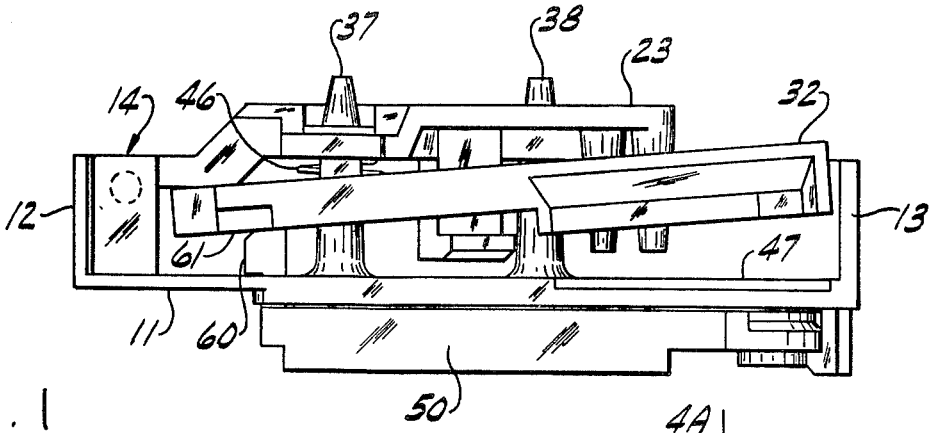
FIG. 12 is a top plan view of the device similar to FIG. 3, but illustrating the gate positions when the coin-scavenging lever is depressed as indicated by phantom lines in FIG. 2.
Figure 1:
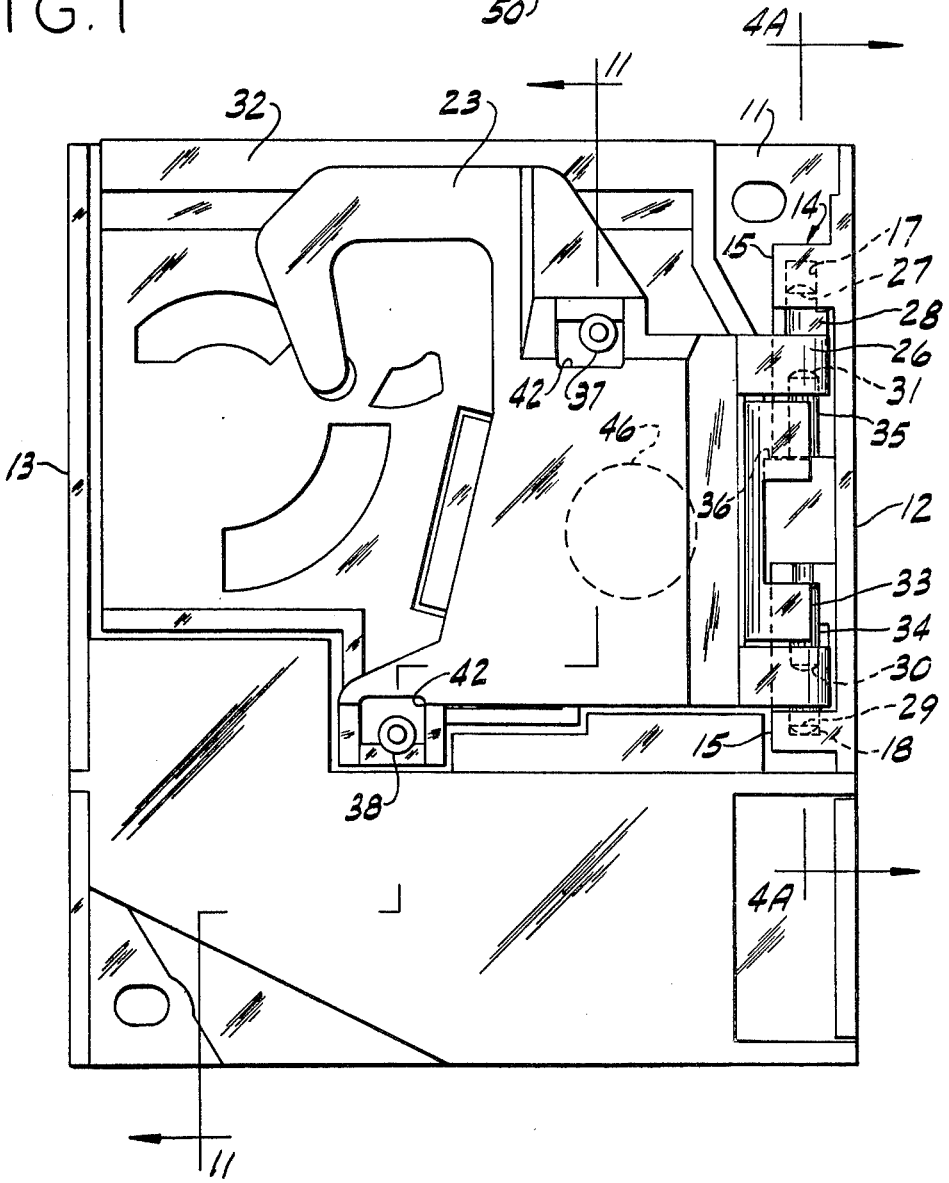
FIG. 1 is a front elevational view of the coin selecting and separating device with the gates hingedly connected and in a closed position relative to the main plate.
Figure 3:
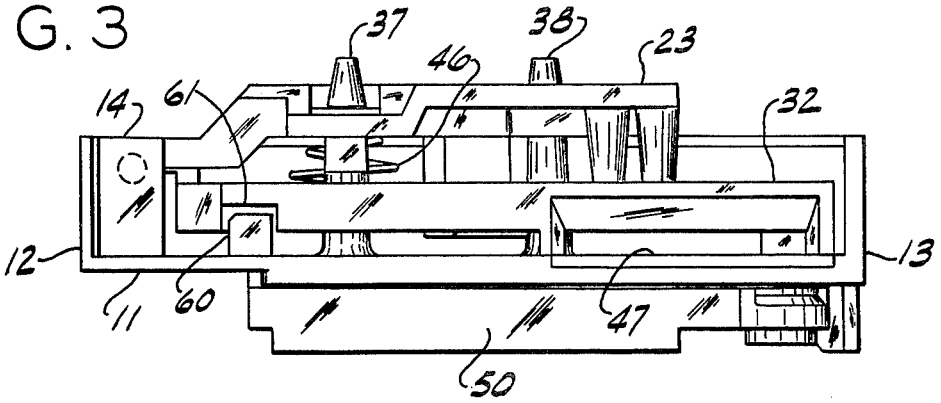
FIG. 3 is a top plan view of the device shown in FIG. 2.

The coin selecting and separating device includes a main plate means generally indicated by 10 having a back plate portion 11 and side flanges 12 and 13 projecting from one side of the back plate portion 11. A first hinge socket means referred to by 14 is provided on the main plate means 10. More particularly, the hinge socket means 14 includes opposed and spaced shoulders 15 and 16 formed integrally with and located inwardly of the side flange 12. The shoulders 15 and 16 are provided with hinge sockets 17 and 18 respectively.

The hinge socket means 14 also includes a depression 20 adjacent each socket 17 and 18, the purpose of which will be described upon more detailed description of parts. Further, the hinge socket means 14 includes an upper flat surface 21 next to each depression 20, each flat surface 21 being provided with a longitudinal groove 22 axially aligned substantially with the hinge axis defined by the aligned hinge sockets 17 and 18. These grooves 22 constitute bearing means as will be later described. The grooves 22 are defined by arcuate margins that constitute abutments, the purpose of which will be also later described.

The gate assembly includes a first gate 23, commonly known as the magnet gate. The first gate 23 includes a hinge portion 24 having arcuate ends adapted to interfit and engage the depressions 20 of the first hinge socket means 14. Formed on the hinge portion 24, is a first hinge pin 27 and a key 28 adapted to interfit the hinge socket 17 in the open position of the gate 23 relative to the main plate means 10. A second pin 29 is formed on the hinge portion 24 and is adapted to interfit the hinge socket 18.

Provided in each of the hinge portions 25–26, is a second hinge socket means consisting of side-open hinge sockets 30 and 31.

A second gate 32, commonly called the 25 cent or 10 cent or 5 cent gate depending upon the particular coin being tested at the gate location, includes a hinge portion 33. Formed on the hinge portion 33 are a pair of hinge pins 34 and 35 adapted to hingedly interfit the hinge sockets 30 and 31 respectively of the first gate 23. In addition, the hinge pins 34 and 35 interfit and engage the bearing grooves 22 formed in the first hinge socket means 14.

Formed on the hinge portion 33 adjacent the hinge pin 35, is a stop member 36 that engages the upper surface 21 of the first hinge socket means 14 to preclude angular movement of the second gate 32 from an open position relative to the main plate means 10 when the pin 27 and key 28 are inserted into the first hinge socket 17, and precludes shifting of the gates 23 and 32 as a unit to cause hinged disconnection of the first gate 23 from the first hinge socket means 14 when the second gate is moved from its open position as will be later described.

Extending forwardly from the back plate 11 of the main plate means 10 are a pair of latch pins 37 and 38, each pin being provided with a keeper shoulder 40. The latch pin 37 extends through a compatible aperture 41 formed in the second gate 32 as the second gate 32 is angularly moved from its open position to a closed position with respect to the main plate means 10. The latch pin 38 projects forwardly below the second gate 32.

The first gate 23 is provided with compatible openings 42 and 43 through which the latch pins 37 and 38 extend respectively as the first gate 23 is moved from its open position to its closed position relative to the main plate means 10. The gate apertures 42–43 are at least partially defined by catch shoulders 44 and 45 adapted to lock behind the keeper shoulders 40 of the latch pins 37–38 respectively when the first gate 23 is moved to its fully closed position.

Figure 11:
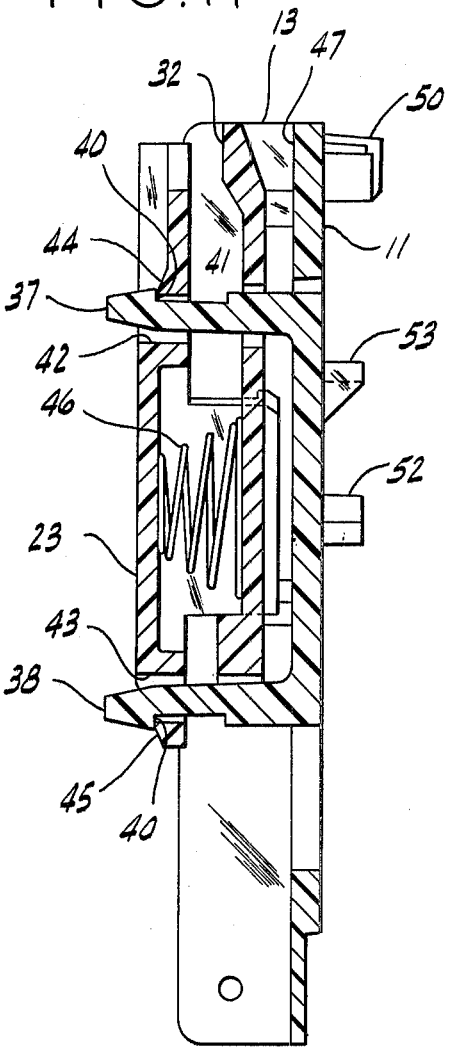
FIG. 11 is a cross-sectional view taken on staggered line 11—11 of FIG. 1.
Figure 14:
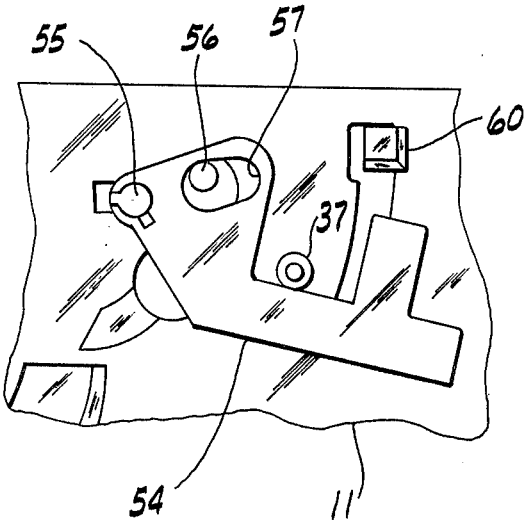
FIG. 14 is a fragmentary front view of the scavenger blade mounted on the back plate.

Carried on the second gate 32 and located between the first and second gates, is a compression spring 46. As is best seen in FIG. 11, when the first and second gates 23–32 are in the fully closed position, the compression spring 46 is pressed between the gates and tends to urge the first gate 23 relatively outward so that the catch shoulders 45 are pressed under loading against the keeper shoulders 40 of the latch pins 37–38. The loading of the compression spring 46 also tends to urge the second gate 32 against the back plate 11 to hold the second gate 32 in its closed position.

The latch pins 37–38 have sufficient lateral resiliency so that they can be pressed laterally to operatively disengage the keeper shoulders 40 from the catch shoulders 44–45 in order to release the first gate 23. The first gate 23 can then be moved from its closed position to the open position. When moved to the closed position, the first gate 23 will engage the latch pins 37 and 38 and cam the pins laterally so that when the gate is fully closed, the latch pins 37–38 will snap the keeper shoulders 40 behind the catch shoulders 44–45 to lock the gate 23.

The second gate 32 and the back plate 11 of the main plate means 10 define a coin entrance chute 47 through which coins are introduced. During the coin selecting and separating operation, it is possible under certain conditions for spurious coins to be trapped between the back plate 11 and the second gate 32. The parts of the device for accomplishing the coin selecting and separating operation are not shown in detail because they do not constitute an essential part of the present invention. To remove these trapped coins, a coin-scavenging mechanism is actuated.

Figure 2:
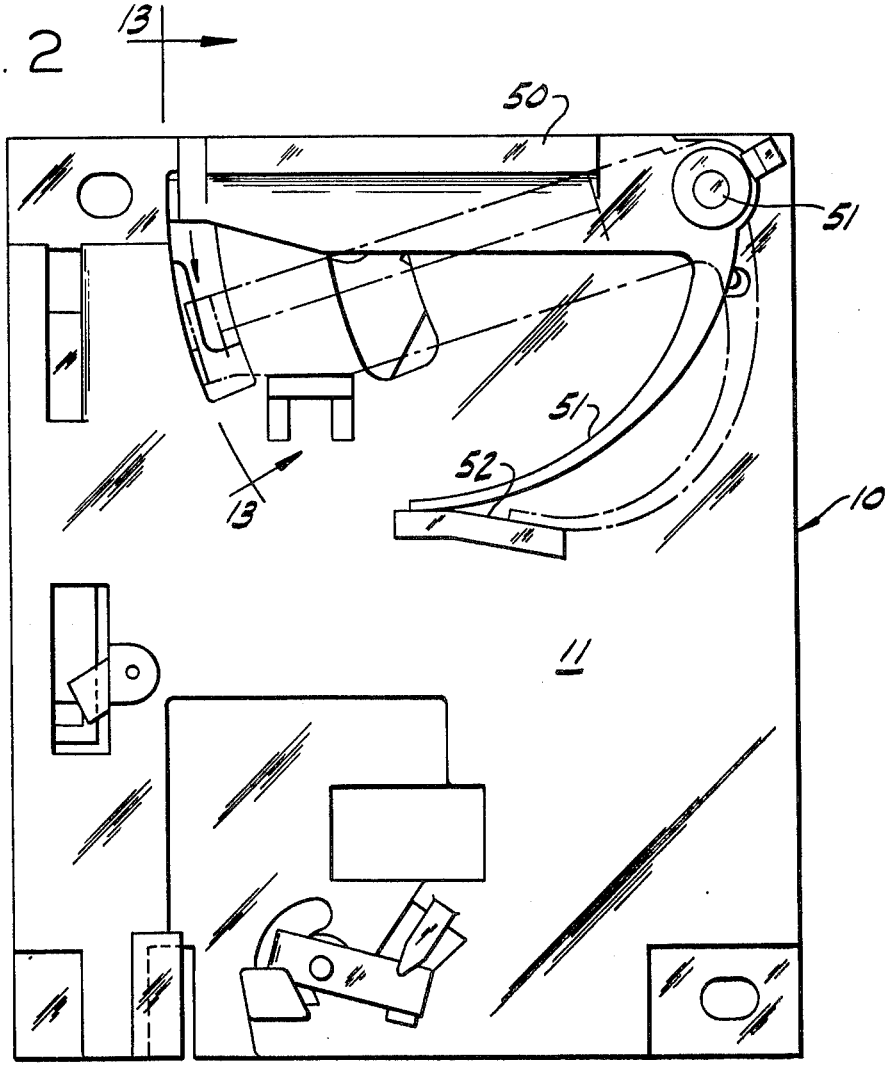
FIG. 2 is a rear elevational view of the device, the phantom lines indicating a depressed position of the coin-scavenging lever.

The coin-scavenging mechanism includes a lever 50 pivotally mounted by pin 51 to the rear of the back plate 11. Formed integrally with the lever 50 is a resilient arm 51 the end of which engages a cam track 52. Also provided on the back plate 11 is a stop ledge 53 adapted to engage the lever 50 when the lever is depressed as is shown in phantom lines in FIG. 2. As the lever 50 is depressed, the resilient arm 51 rides on the cam track 52 and deflects the resilient arm to cause a resilient loading tending to urge the lever 50 upwardly to its initial position shown in full lines in FIG. 2.

A scavenger blade 54 is pivotally mounted by pin 55 to the back plate 11, and is located between the back plate 11 and the second gate 32. A pin 56 on the lever 50 extends through the back plate 11 and engages the scavenger blade 54 in the blade slot 57. As the lever 50 is depressed, the lever pin 56 will swing the scavenger blade 54 downwardly about its pivot pin 55, and thereby urges any trapped coin toward a discharge passage.

The lever 50 is also provided with a cam projection 60 extending through the back plate 11 and engaging a cam track 61 formed at the rear of the second gate 32. As the lever 50 is depressed, the cam projection 60 will engage the cam track 61 and urge the second gate outwardly from its fully closed position, as is best illustrated in FIG. 12, thereby increasing the space between the second gate 32 and back plate 11 so that any trapped coin may be freed. The compression spring 46 enables this angular movement of the second plate 32 relative to the latched first gate 23, and resiliently returns the second gate 32 to its fully closed position as the lever 50 is moved upwardly to its initial position.

Figure 4:
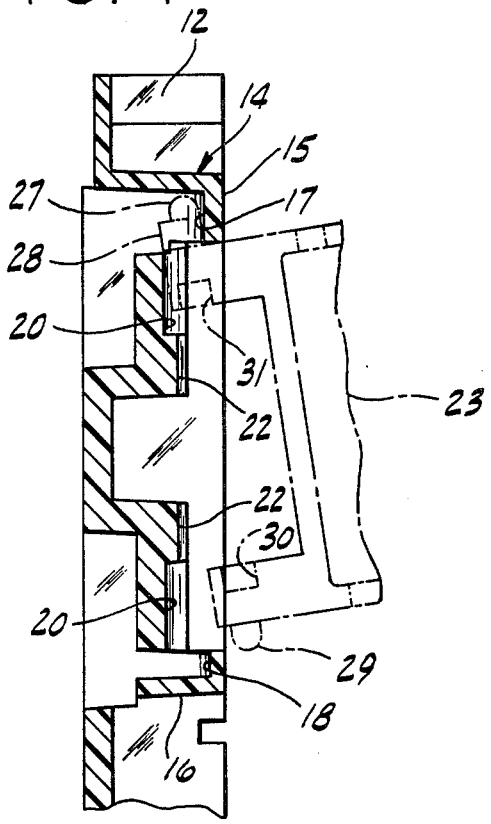
FIG. 4 is a cross-sectional view of the hinge connection taken on line 4—4 of FIG. 1, but illustrating the gates in phantom lines to show the first step of connecting the gates.
Figure 5:
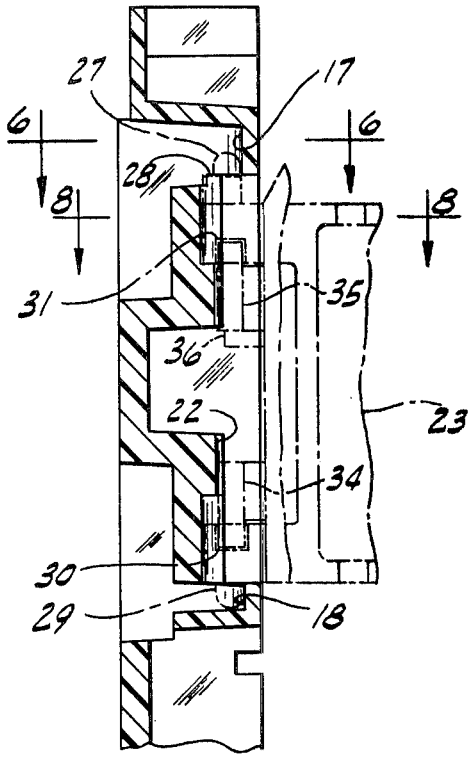
FIG. 5 is a cross-sectional view similar to FIG. 4, but showing the gates shifted as a unit and hingedly connected.
Figure 6:
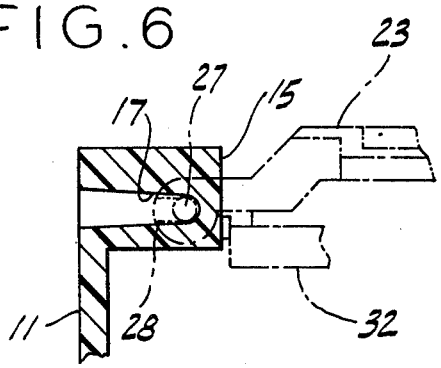
FIG. 6 is a cross-sectional view taken on line 6—6 of FIG. 5 with the gates in an open position.
Figure 8:
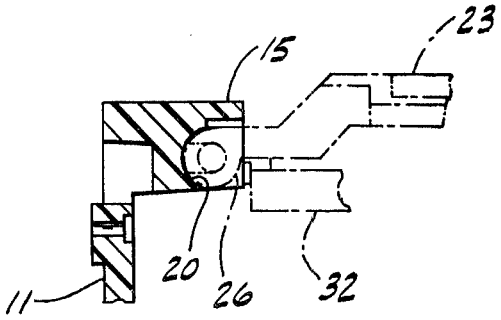
FIG. 8 is a fragmentary cross-sectional view taken on line 8—8 of FIG. 5 with the gates in an open position.
Figure 7:
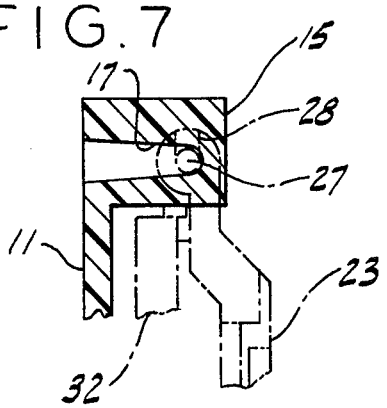
FIG. 7 is a cross-sectional view similar to FIG. 6 but showing the gates in a closed position.
Figure 9:
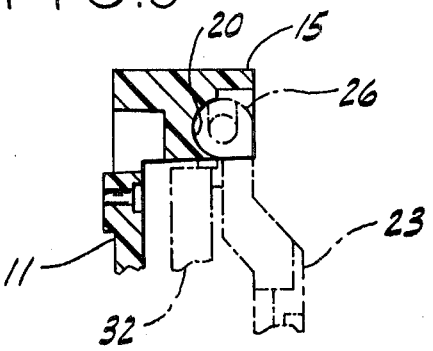
FIG. 9 is a fragmentary cross-sectional view similar to FIG. 8, but showing the gates in a closed position.
Figure 10:
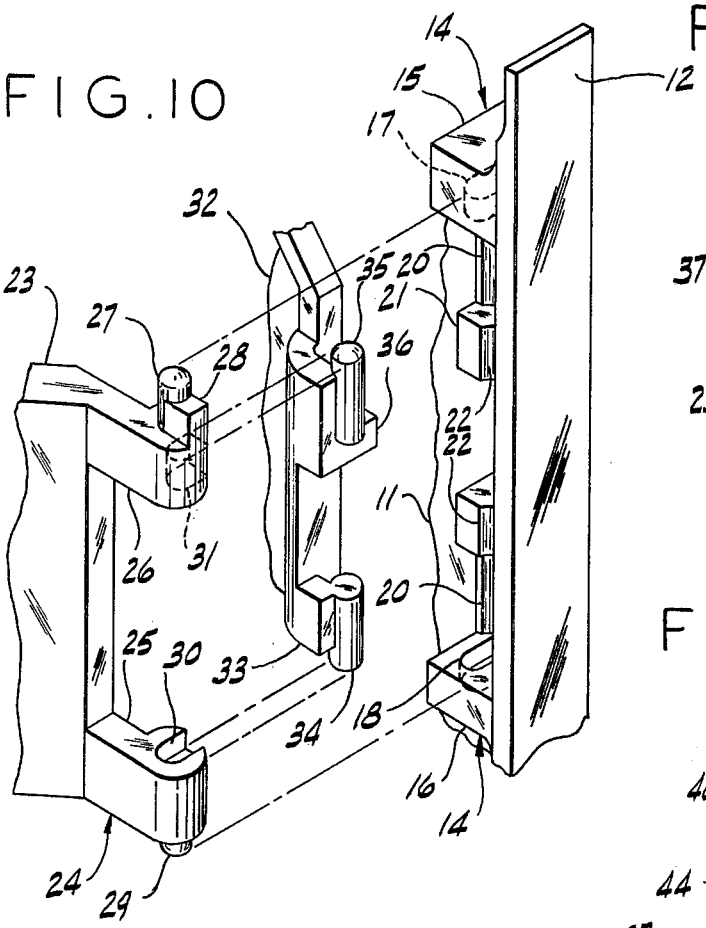
FIG. 10 is a perspective view of the hinge connection between the main plate and gates.
Figure 13:
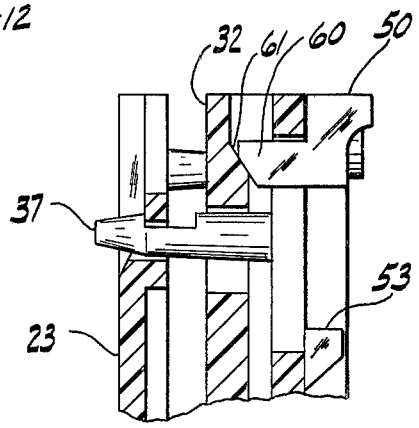
FIG. 13 is a fragmentary, cross-sectional view as taken on the arcuate line 13—13 of FIG. 2.

To assemble the gates 23 and 32, the gates are placed together with the hinge pins 34–35 of the second gate 32 located in the hinge sockets 30–31 of the first gate 23. Then, the hinge pin 27 and key 28 of the first gate 23 are inserted first into the hinge socket 17 as is illustrated best in FIG. 4. Then, the hinge pin 29 of the first gate is moved into alignment with its associated hinge socket 18. The ends of the hinge portions 25–26 are then located in the compatible depressions, and the hinge pins 34–35 are located in the associated grooves 22. In this open position of the gates 23 and 32, the key 28 engages the hinge socket 17 to preclude movement of the first gate 23 from its open position, and the stop member 36 of the second gate 32 engages the upper surface 21 of the first hinge socket means 14 to preclude angular movement of the second gate 32 from its open position.

Then, the gates 23 and 32 are shifted as a unit so as to withdraw the key 28 from its associated hinge socket 17 and to insert the pin 29 into its hinge socket 18, thereby hingedly connecting the first gate 23. The first gate can then be moved from its open position to its closed position. Because the hinge pins 34–35 of the second gate 32 are located in the associated bearing grooves 22, the abutment means provided by the margins of such grooves 20 preclude removal of the hinge pins 34–35 from the associated hinge sockets 30–31.

When the second gate 32 is moved from its open position, the stop member 36 will overlap and engage the end of the adjacent upper surface 21 to preclude shifting of the gates 23 and 32 as a unit to hingedly disconnect the first gate 23 from the first hinge socket means 14.

In order to hingedly disconnect the gates 23 and 32, both gates are moved to the open position relative to the main plate means 10, and while held together are shifted as a unit so as to withdraw the hinge pin 29 of the first gate from its hinge socket 18 and to insert the key 28 of the first gate 23 into the hinge socket 17. Then the freed ends of the gates 23 and 32 can be swung outwardly, and then the hinge end 27 and key 28 can be removed from the associated hinge socket 17.

When the gates 23 and 32 are hingedly connected, and are moved toward the closed position, the first gate will engage the latch pins 37 and 38 and resiliently deflect the pins so that when the first gate 23 is fully closed, the latch pins 37 and 38 will snap so that the keeper shoulders 40 will effectively engage the catch shoulders 44–45 to latch the first gate 23 in the closed position. The spring loading of the compression spring 46 will urge the first gate 23 outwardly against the latch pins to hold the first gate 23 in place in the closed position. Moreover, the loading of the compression spring 46 will hold the second gate 32 against the back plate 11 in its fully closed position.

As explained previously, in order to release a trapped spurious coin between the second gate 32 and the back plate 11, the lever 50 is depressed so that the cam projection 60 engages the cam track 61 of the second gate 32, so as to urge the second gate 32 outwardly about its hinge connection against the loading of the compression spring 46. Engagement of the lever 50 with the stop ledge 53 determines the depressed position of the lever 50. The resilient arm 51 riding on the cam track 52 tends to urge the lever 50 back to its initial position when the lever 50 is released. As the lever 50 is moved back to its initial position, the compression spring 46 will urge the second gate 32 back to its fully closed position relative to the back plate 11.

I claim as my invention:

1. A gate assembly for a coin selecting and separating device, comprising:

(a) a mainplate means, (b) a first hinge socket means on the mainplate means, (c) a first gate including:

(1) a first pin inserted into the first hinge socket means, (2) a second pin aligned but operatively disconnected from the first hinge socket means in an open position of the gate relative to the mainplate means, and (3) key means for precluding angular movement of the first gate from the open position, (d) a second hinge socket means on the first gate, (e) a second gate including pin means disposed in the second hinge socket means, and (f) the first and second gates being shiftable as a unit in the open position to operatively disengage the key means and to insert the second pin of the first gate into the first hinge socket means for hingedly connecting the first gate for angular movement of the gates to a closed position relative to the mainplate means.

2. A gate assembly for a coin selecting and separating device as defined in claim 1, in which:

(g) the second gate includes stop means precluding angular movement of the second gate from an open position relative to the mainplate means when the second pin of the first gate is operatively disconnected from the first hinge socket means, and permitting angular movement of the second gate to a closed position relative to the mainplate means when said second pin is inserted into the first hinge socket means for hingedly connecting the first gate.

3. A gate assembly for a coin selecting and separating device as defined in claim 1, in which:

(g) the key means is inserted into and engages the first hinge socket means to preclude angular movement of the first gate from the open position, and is withdrawn and disengaged from the first hinge socket means when the first and second gates are shifted as a unit in the open position to insert the second pin of the first gate into the first hinge socket means for hingedly connecting the first gate.

4. A gate assembly for a coin selecting and separating device as defined in claim 1, in which:

(g) abutment means on the mainplate means engages the second gate to preclude removal of the pin means of the second gate from its associated second hinge socket means when the first gate is hingedly connected.

5. A gate assembly for a coin selecting and separating device as defined in claim 2, in which:

(h) the stop means of the second gate engages the mainplate means when the second gate is moved from its open position to preclude shifting of the first and second gates to disconnect the first gate hingedly from the first hinge socket means.

6. A gate assembly for a coin selecting and separating device as defined in claim 2, in which:

(h) the key means is inserted into and engages the first hinge socket means to preclude angular movement of the first gate from the open position, and is withdrawn and disengaged from the first hinge socket means when the first and second gates are shifted as a unit in the open position to insert the second pin of the first gate into the first hinge socket means for hingedly connecting the first gate, and (i) abutment means on the mainplate means engages the second plate to preclude removal of the pin means of the second gate from its associated second hinge socket means when the first gate is hingedly connected.

7. A gate assembly for a coin selecting and separating device as defined in claim 1, in which:

(g) the first hinge socket means includes opposed and spaced shoulders, each shoulder being provided with a hinge socket, (h) the first gate includes a hinge portion disposed between the shoulders, the first and second pins and the key means being provided on the hinge portion, the said first pin and key means being inserted into one hinge socket and the second pin being aligned with the other hinge socket in the open position of the first gate, and (i) the key means engages its associated shoulder to preclude angular movement of the first gate from the open position, and is operatively disengaged from its associated hinge socket and associated shoulder upon shifting the first and second gates as a unit in the open position incident to inserting the second pin of the first gate into said other hinge socket for hingedly connecting the first gate.

8. A gate assembly for a coin selecting and separating device as defined in claim 7, in which:

(j) the hinge portion of the first gate is provided with hinge sockets receiving the pin means of the second gate.

9. A gate assembly for a coin selecting and separating device as defined in claim 8, in which:

(k) bearing means on the mainplate means rotatively seats the pin means of the second gate, the bearing means including an abutment engaging the pin means to preclude removal of the pin means from its associated hinge sockets when the first gate is hingedly connected.

10. A gate assembly for a coin selecting and separating device, comprising:

(a) a mainplate means, (b) a first hinge socket means on the mainplate means including opposed and spaced shoulders, each shoulder being provided with a hinge socket, (c) a first gate including a hinge portion disposed between the socket shoulders, the hinge portion having a first pin and a key means inserted into one hinge socket and a second pin aligned with the other hinge socket in the open position of the first gate, the key means engaging its associated shoulder to preclude angular movement of the first gate from the open position, (d) a second hinge socket means on the hinge portion of the first gate, (e) a second gate including a hinge portion having pin means disposed in the second hinge socket means, (f) stop means precluding angular movement of the second gate from an open position relative to the mainplate means when the said first pin and key means of the first gate is inserted into its associated hinge socket and the second pin of the first gate is aligned with but operatively disconnected from its associated hinge socket, (g) the first and second gates being shiftable as a unit in the open position to operatively disengage the key means from its associated shoulder and to insert the second pin of the first gate into its associated hinge socket for hingedly connecting the first gate for angular movement of the first gate to a closed position relative to the mainplate means, the stop means of the second gate then permitting angular movement of the second gate to a closed position relative to the mainplate means, (h) the stop means of the second gate engaging the mainplate means when the second gate is moved from its open position to preclude shifting of the first and second gates as a unit to disconnect hingedly the first gate from the first hinge socket means, and (i) bearing means on the mainplate means rotatively seating the pin means of the second gate, the bearing means including an abutment engaging the pin means to preclude removal of the pin means from its associated hinge sockets when the first gate is hingedly connected.

* * * * *